United States Patent [19]

Harrell

[11] Patent Number: 4,507,882

[45] Date of Patent: Apr. 2, 1985

[54] DETACHABLE SHOE-POCKET SYSTEM

[76] Inventor: Bruce W. Harrell, 3402 Auchentoroly Ter., Baltimore, Md. 21217

[21] Appl. No.: 504,888

[22] Filed: Jun. 16, 1983

[51] Int. Cl.[3] ..... A41B 3/16

[52] U.S. Cl. ..... 36/136; 2/247; D2/265

[58] Field of Search ..... 36/114, 132, 136; 2/245, 247, 251; 40/2 E; D2/265

[56] References Cited

U.S. PATENT DOCUMENTS

| | | | |
|---|---|---|---|
| 776,767 | 12/1904 | Waters | 36/136 X |
| 1,100,758 | 6/1914 | McAuslin | 36/136 X |
| 1,640,665 | 8/1927 | Muscente | 2/245 |
| 2,095,869 | 10/1937 | Hermson | 40/2 E X |
| 2,662,677 | 12/1953 | Perry | 36/136 X |
| 3,334,357 | 8/1967 | Stults | 2/247 |
| 4,372,060 | 2/1983 | Adamik | 36/136 X |

FOREIGN PATENT DOCUMENTS

WO80/01750 9/1980 PCT Int'l Appl. ..... 36/132

*Primary Examiner*—Werner H. Schroeder
*Assistant Examiner*—Tracy Graveline
*Attorney, Agent, or Firm*—John F. McClellan, Sr.

[57] ABSTRACT

A quick-attach, quick-detach shoe accessory in the form of a container for carrying keys, rings, paper money, coins and like items on the instep of a tennis shoe or other lace type shoe, has a sheath-like body with open top end with a covering flap and closed bottom and pleated sides securable to a shoe by a tongue attached to the bottom, passing beneath the shoe laced portion and terminating at the top in an end having a pair of shoe-lace holes matching another pair of shoe-lace holes in an upward extension of the body so that shoe laces may be passed through the shoelace holes and tied, holding the container on the top of the instep of the user's foot.

7 Claims, 12 Drawing Figures

DETACHABLE SHOE-POCKET SYSTEM

FIELD OF THE INVENTION

This invention relates generally to apparel and specifically to a shoe accessory.

BACKGROUND OF THE INVENTION

A problem frequently encountered by many people is what to do with rings, coins, paper money, keys, matches and other small items while engaging in a favorite sport.

Customarily, sweat suits and tennis shoes or other lace type athletic shoes will be worn.

OBJECTS OF THE INVENTION

A principal object of this invention is to provide a detachable shoe-pocket system that will conveniently and securely hold and keep safe small items no matter how violently the wearer exercises.

Further objects are to provide a system as described which is readily accessible for loading and unloading, which fits most lace type shoes, which is lightweight, water resistant, durable and attractive in appearance.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

Figure 1:
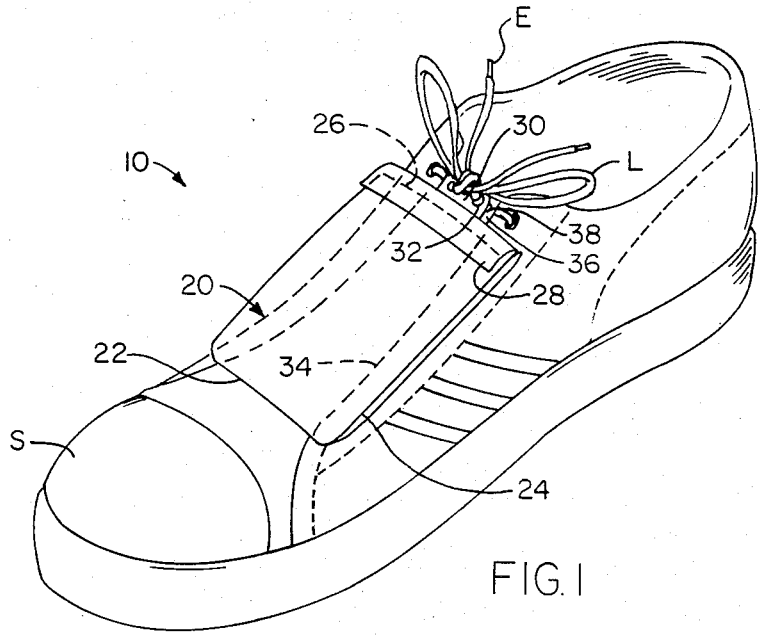
FIG. 1 is a perspective view of the invention in use on a shoe.

FIG. 1 shows the invention in embodiment 10 installed on a representative lace type athletic shoe S.

The invention has a unitary body that includes an expansible sheath 20 having closed bottom 22 and sides 24 and an open top 26 covered by an openable flap 28.

Securing the substantially planar unit 10 to the shoe S is a perforate rectangular upward extension 30, with two laterally related holes 32 in it and a perforate flat tongue 34 attached beneath the edge of the bottom 22 and proportioned for extending freely up beneath the laced portions of the shoe to an upper end 36 similar in shape and size to the upward extension 30 and with two holes 38 in it respectively congruent with the holes 32 in the upward extension 30.

The unit 10 covers the laced portions of the shoelaces L, the tongue 34 is passed up beneath the shoelaces, and the ends E of the shoelaces are passed through both sets of holes and tied.

Because of the proportions and proximity of the flap 28 and shoe lace holes, tying the shoelaces tightly bends the flap 28 around the foot; the outward convexity of the bend tends to keep the flap securely closed.

Even with the shoelaces tied, raising the flap 28 which flexibly hinges about the upper edge gives good access to the pocket formed by the sheath 20. The sheath is large enough preferably, to extend at least the length of the laced portion of the shoe and wide enough to cover the laced portion of the shoe. It can be made in various sizes.

Figure 2:
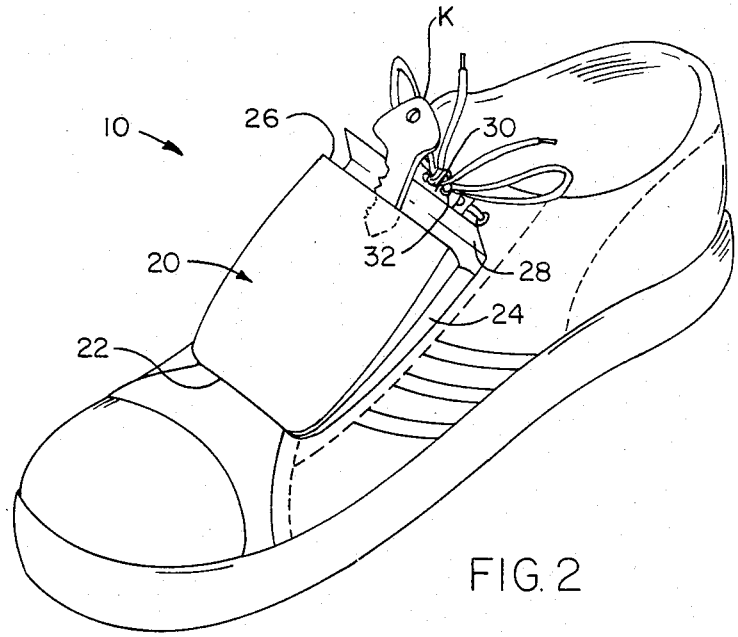
FIG. 2 is a perspective view showing access to the invention on a shoe for storing small items.

FIG. 2 shows that the sides 24 of the sheath 20 may be in the form of pleats or accordion folds for expansion of the sheath to permit easier loading and unloading of items, such as the key K shown.

Figure 3:
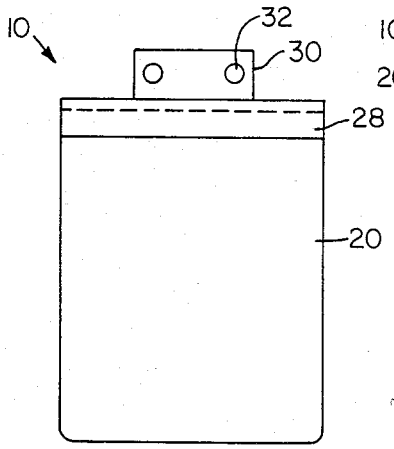
FIG. 3 is a front elevational view in closed position.

FIG. 3 shows in face view the upward extension 30 with holes 32 extending above flap 28 which closes the top of the sheath 20.

Figure 4:
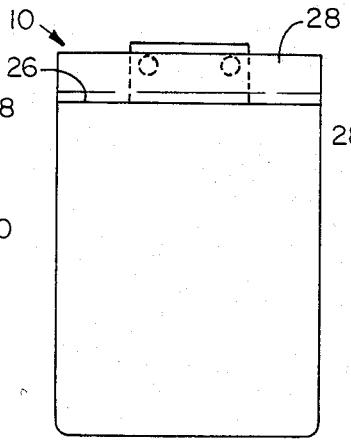
FIG. 4 is a front elevational view in open position.

FIG. 4 shows the face view with the flap 28 in open position, exposing open top 26.

Figure 5:
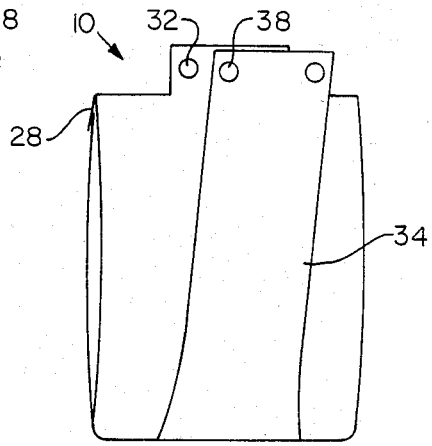
FIG. 5 is a rear perspective view in closed position.

FIG. 5 shows in rear quartering view the tongue 34, which is broader at the bottom to engage the sides of the shoe beneath the laces and prevent lateral shifting. The matching relation of holes 32 and 38 also appears. The flap 28 is shown closed.

Figure 6:
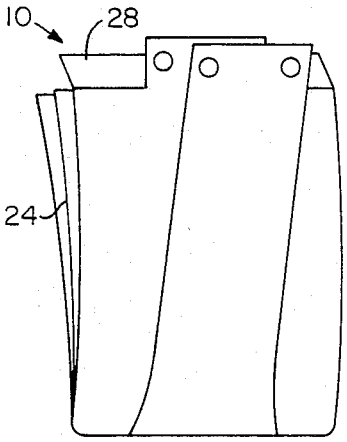
FIG. 6 is a rear perspective view in open position.

FIG. 6 shows the same view with the flap 28 open and the pleated sides 24 extended for loading or unloading.

Figure 7:
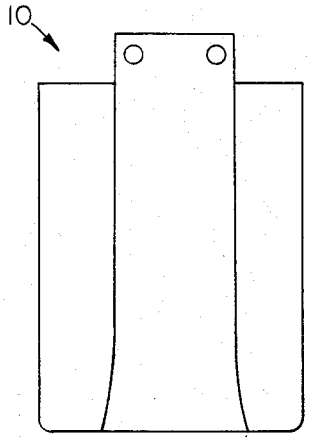
FIG. 7 is a rear elevational view in closed position.

FIG. 7 shows the rear face view of the invention 10.

Figure 8:
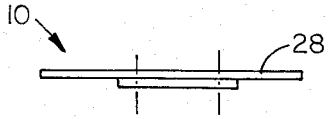
FIG. 8 is a top plan view in closed position.

FIG. 8 shows the top plan view with flap 28 closed.

Figure 9:
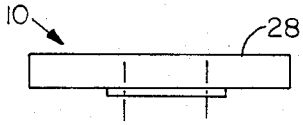
FIG. 9 is a top plan view in open position.

FIG. 9 shows the top plan view with flap 28 open.

Figure 10:
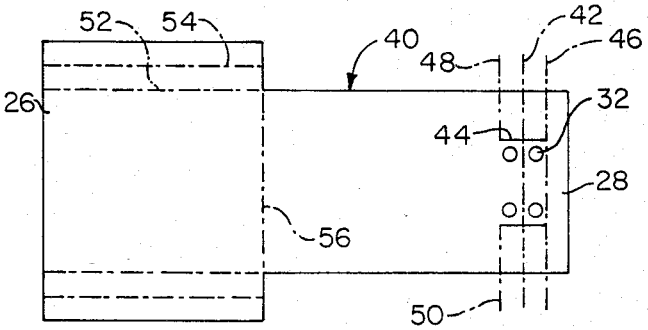
FIG. 10 shows a flat pattern.

FIG. 10 shows the layout of the flat pattern 40 from which is made, by folding and cementing or sewing, all but the tongue, which is separately cemented or otherwise affixed. The material preferably is of any suitable thermoplastic material such as flexible polystyrene or polyethylene sheet, but may be of canvas or the like.

The pattern is generally rectangular with a "T" shape at one (the top) end 26 and four holes 32, two on either side of a transverse fold line 42, at the other end. A pair of parallel slits 44 lie respectively outboard the holes on either long side. Fold line 46 is for the flap, fold lines 48, 50 are for flap-anchor tabs, and fold lines 52, 54 are for the pleats in the sheath. Fold lines 56 is between front and back of the sheath.

Figure 11:
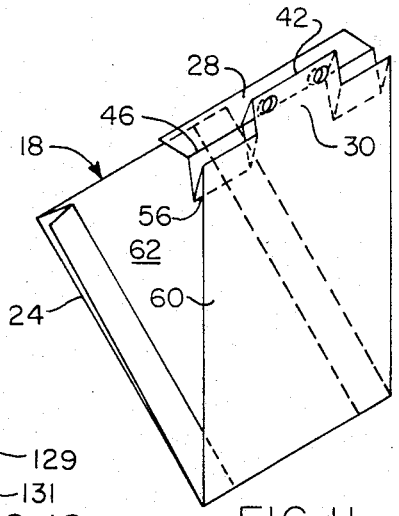
FIG. 11 is a rear perspective view of a part of the invention in an intermediate position of fabrication.

FIG. 11 shows an intermediate step in folding and cementing or otherwise affixing the parts of the pattern to comprise all but the tongue, namely the body 18 of the invention.

Transverse fold along line 42 doubles the rectangular upward extension 30 for strength at this point of attachment; flap 28 folds full width along line 46 giving a full width hinge for the flap; flap anchor (inward) tabs 56 are fully cemented or otherwise affixed by joining the two layers and the inner member or back wall 60 and the faces of the pleats, sides 24 which are integral with the front wall or outer member 62 of the sheath are continuously joined to the margin of inner member 60 of the sheath.

The stress points are therefore substantially strengthened.

It will be appreciated that the laces of a shoe do not need to be untied for access to the pocket formed by the invention, but must be both untied and loosened for removal of the invention from a shoe, making loss very unlikely. Loads carried are carried on the top of the instep of the foot of a user, out of the way of the other foot and in position unlikely to be struck against the ground. A shoe on either foot can be used, or both shoes for greater capacity. The units can be supplied in a variety of colors and may bear advertisements or emblems of the like.

Figure 12:
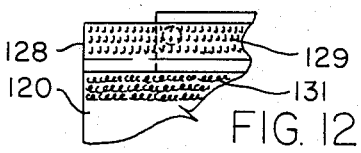
FIG. 12 is a fragmentary elevational showing of an alternative embodiment.

FIG. 12 shows in a view similar to FIG. 4, "Velcro" brand fabric fastening material as at 129, 131, of the flap 128 to the sheath body 120 adjacent the lower edge of the opening, for detachably securing the flap in closed position.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by U.S. Letters Patent is:

1. A shoe pocket system comprising: a body including a sheath with a closed bottom and sides and an open top, and means for mounting the sheath on the instep of a lace-type shoe, said means for mounting including a tongue having perforations at an upper end thereof; said tongue attached at said closed bottom and proportioned for extending freely to said perforate upper end; a perforate upward extension of said body above said open top, and said perforations of the tongue and perforate upward extension being in alignment for shoe lace passage therethrough and tying for securing the shoe pocket system on shoe instep.

2. A shoe pocket system as recited in claim 1, said sides being pleated for providing better access to said open top.

3. A shoe pocket system as recited in claim 2, and a flexible flap for covering said open top.

4. A shoe pocket system as recited in claim 3, the flap having proportions and location for causing the flap to bend and keep securely closed upon said shoe lace tying.

5. A shoe pocket system as recited in claim 3, and "Velcro" brand fabric fastening material located on said flap and said sheath for detachably securing the flap in closed position.

6. A shoe pocket system as recited in claim 1, said body being unitary.

7. A shoe pocket system as recited in claim 1, said tongue being wider adjacent said closed bottom end than at said perforate upper end, for preventing shifting on a said shoe.

* * * * *